US005987932A

United States Patent [19]

Baseggio et al.

[11] Patent Number: 5,987,932

[45] Date of Patent: Nov. 23, 1999

[54] SLIDER TYPE NEEDLE FOR KNITTING MACHINE

[75] Inventors: Marcello Baseggio; Michel Prost, both of Ollon; Claude-Yvan Marcoz, St-Maurice, all of Switzerland

[73] Assignee: Atelier De Construction Steiger S.A., Vionnaz, Switzerland

[21] Appl. No.: 09/073,324

[22] Filed: May 5, 1998

[30] Foreign Application Priority Data

May 27, 1997 [CH] Switzerland ..... 1234/97

[51] Int. Cl.[6] ..... D04B 35/06

[52] U.S. Cl. ..... 66/120; 66/116

[58] Field of Search ..... 66/64, 68, 71, 66/62, 74, 75.1, 76, 77, 96 R, 120

*Primary Examiner*—John Calvert
*Assistant Examiner*—Larry D. Worrell Jr.
*Attorney, Agent, or Firm*—Bugnion S.A.; John Moetteli

[57] ABSTRACT

A slider type needle for a knitting machine, comprising a needle (1) equipped with a beard (3) and a slider (2) having an associated length, a butt (4), a nose (5) and a stitch bearing shoulder (6), this slider being displaceable relative to the needle in order to close and open the beard of the needle and in order to permit the nose and shoulder of the needle to drive a stitch so as to execute a stitch transfer. The slider (2) has a U-shaped profile enabling it to straddle the needle (1). The slider is split (7, 15) in its end region, in order to allow an opposite needle or slider to pass through in order to carry out a stitch transfer or punching. This needle affords new knitting possibilities, in particular it makes it possible to carry out punching without an auxiliary section.

3 Claims, 2 Drawing Sheets

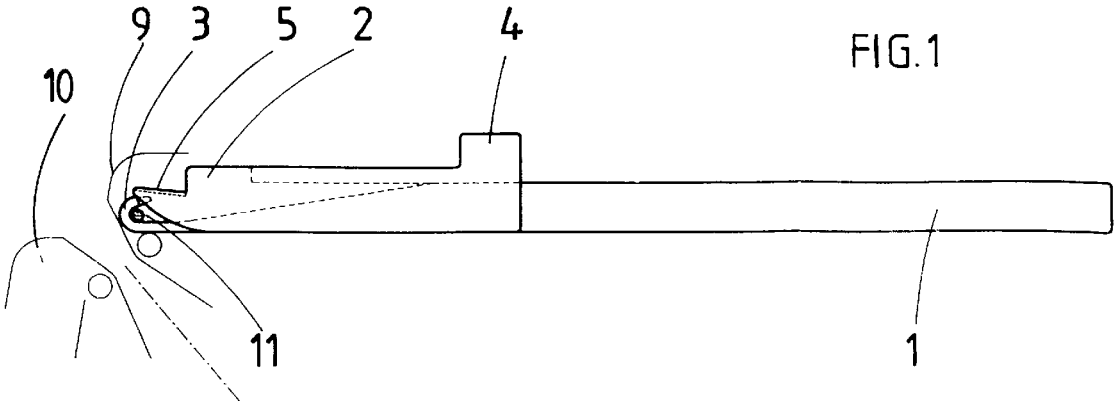
FIG. 1
FIG. 2
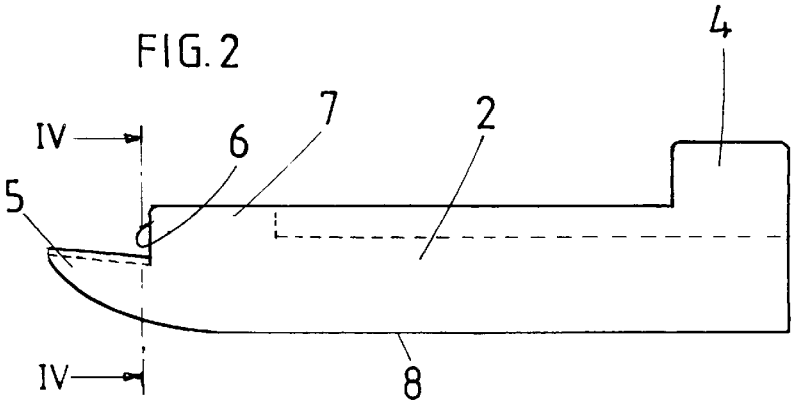
FIG. 4
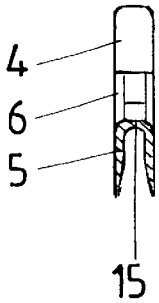
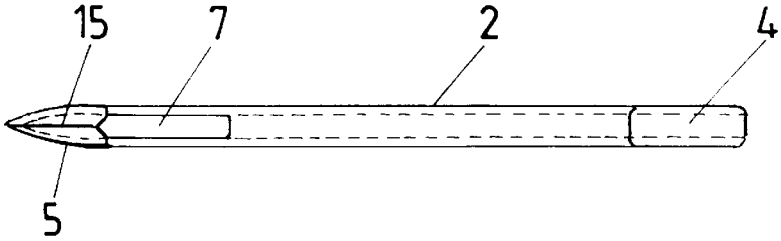
FIG. 3

SLIDER TYPE NEEDLE FOR KNITTING MACHINE

FIELD OF THE INVENTION

The subject of the present invention is a slider type needle for a knitting machine, comprising a needle equipped with a beard and a slider equipped with a butt, with a nose and with a switch bearing shoulder, this slider being displaceable relative to the needle in order to close and open the beard of the needle by means of the nose of said slider and in order to drive a stitch by means of the nose and shoulder of the latter so as to execute a stitch transfer.

PRIOR ART

Slider type or piston type needles have been known for a long time.

The first slider type needle for industrial use, produced by J. F. WILCOMB in 1924, has a needle which is displaced within a slider. This design made it possible only to close the beard of the needle but not to transfer the stitch by means of the slider.

The patents U.S. Pat. Nos. 4,043,153 and 5,186,026 and the patent applications DE 31 51 150, 32 20 049 and U.S. Pat. No. 4,231,015 disclose slider type needles, the actual needle of which is in the form of a slider, in which a piston is displaced, said piston closing the beard of the needle. The use of a piston to close the beard of the needle makes it possible to dispense with the latch of traditional needles, thus making it possible to obtain a more robust needle and to reduce the stroke of the needle when the stitch is being formed. The piston makes it possible, moreover, to carry out a stitch transfer from a needle of one section to a needle of the opposite section. This design with a piston and a needle in the form of a slider was adopted by other manufacturers. The needle is always under the piston, except in the design according to the patent U.S. Pat. No. 4,434,627, in which the piston, having a U-shaped profile, is under the needle.

To execute the stitch transfer, the slider type needle is sometimes equipped with an attached part fastened to the side of the needle (DE 36 24 038).

Compound needles with a lateral spring and needles with a double slider are also known.

In general terms, with piston type needles of the prior art, the transferred stitch is always received by and in the beard of the needle. Consequently, if a stitch is already present in the beard of this needle, it is impossible to differentiate the subsequent transfer or knitting action for each of these stitches.

On the other hand, in order to transfer a set of stitches from a particular number of needles to adjacent needles laterally, this operation commonly being referred to as "punching", it is necessary to make use of an auxiliary section, in which needles or punches pick up the stitches on the needles in order to transfer them to the other needles.

SUMMARY OF THE INVENTION

The object of the invention is to produce a slider type needle affording new knitting possibilities, in particular the possibility of punching without an auxiliary section and auxiliary punches.

The slider type needle according to the invention is defined in that the slider has a U-shaped profile, by means of which it straddles the needle, and in that it is split in its end region comprising the nose, so as to allow an opposite needle or slider to pass through in order to carry out a stitch transfer or punching.

In a flat bed knitting machine with two longitudinally displaceable sections, the slider type needle according to the invention thus makes it possible to perform not only the known stitch transfer function, but also the punching function for the needles of the opposite section, simply as a result of the displacement of a section. It is thus possible to dispense with an auxiliary section and with its punches.

Since the slider straddles the needle, the latter can be retracted into the slider together with one or more stitches, whilst another stitch can remain on the slider which is held in the high position. The stitches present on the sliders can then be transferred onto the sliders or into the beards of the needles of the same section or of the opposite section. It is thus possible, with one and the same needle, to separate stitches and to work them in different ways.

So as not to damage the stitch or stitches which are thus located within the slider, the latter has, over part of its length, starting from its nose, an inner width which is substantially greater than the thickness of the needle, so as to make it possible for the stitch or stitches located in the beard of the needle to pass through.

The displacements necessary for the various operations of the slider type needle according to the invention are of very low amplitude. This makes it possible to reduce the length of the cam holder, reduce the travel of the carriage and increase the production of knitted fabric.

In summary, the slider type needle according to the invention makes it possible:

a) to receive a stitch on a slider, whilst having one or more stitches in the beard of the needle corresponding to the receiving slider;

b) to receive a stitch in the beard of the needle;

c) to transfer this stitch or another stitch, whilst keeping one or more stitches in the beard of the needle corresponding to the slider carrying out the transfer, the stitch or stitches present in the beard of the needle capable of subsequently being transferred or knitted;

d) to use the slider as a relay element for displacing one stitch or a set of stitches of the same section by punching.

BRIEF DESCRIPTION OF THE DRAWINGS

The accompanying drawing illustrates an embodiment of the slider type needle according to the invention, by way of example.

FIG. 1 shows a side view thereof in the formation position.

FIG. 2 is a side view of the slider only.

FIG. 3 is a top view of the slider, in the direction of the arrow of FIG. 2.

FIG. 4 is a sectional view according to IV—IV of FIG. 2.

DESCRIPTION OF THE PREFERRED EMBODIMENT

Figure 5:
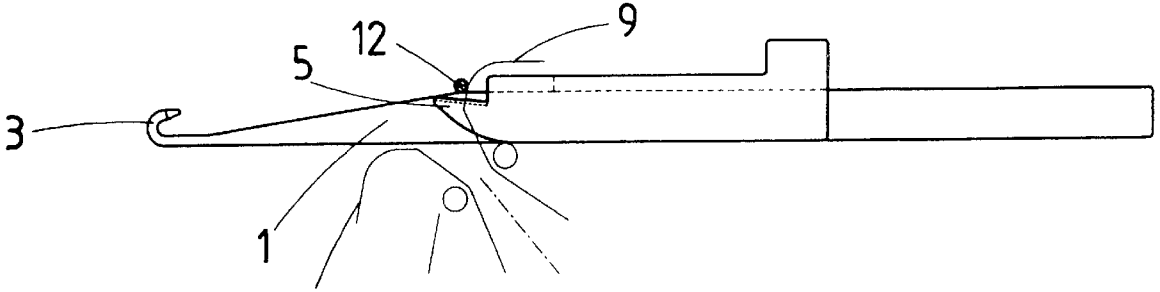
FIG. 5 shows the slider type needle in the position for preparing for a stitch transfer.

The slider type needle shown consists of a needle 1 and of a slider 2, within which the needle 1 slides.

The needle 1 is equipped at its end with a beard 3. In the embodiment shown, the needle 1 does not have a butt, since it is assumed to be driven by a key. However, it could be equipped with one or more butts for driving it by means of the cams of the cam holder.

The slider 2 has a U-shaped profile (FIG. 4), by means of which it straddles the needle 1. At the rear, the slider 2 is equipped with a butt 4 for driving it, and, at the front, it has a nose 5, the upper part of which is located below the level of the back of the slider, so as to form a shoulder 6. On the nose 5, the sides of the slider close again along a joining line 15, so as to form a rounded sliding surface for the stitches. Moreover, the edges of these sides are rounded between the end of the nose 5 and the lower edges 8 of the slider. At the rear of the shoulder 6, the U-shaped profile is interrupted over a particular length, so as to form a passage 7 on the back of the slider. A split is defined by passage 7 and joining line 15. Over part of the length of the slider, starting from its nose 5, the average width of the U-shaped profile of the slider is substantially greater than the thickness of the needle 1. FIGS. 1, 5, 6 and 7 show diagrammatically the profile of two opposite sections 9 and 10 of a flat-bed knitting machine with two sections.

In FIG. 1, the beard 3 of the needle 1 is closed by the nose 5 of the slider, in such a way that the yarn 11 is trapped in the beard of the needle.

FIG. 5 shows the slider type needle in the position for preparing for the stitch transfer. The needle 1 is in a high position. By sliding on the needle, the yarn 12 is raised above the nose 5 of the slider.

Figure 6:
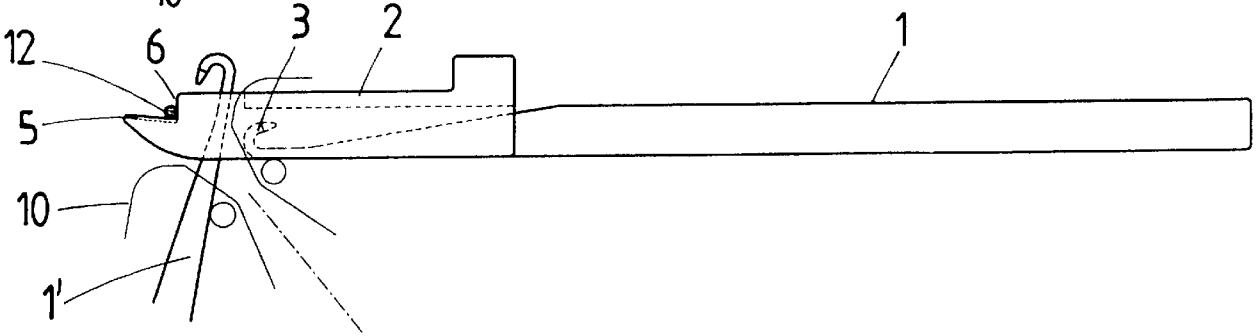
FIG. 6 shows the slider type needle in the stitch transfer position.

In FIG. 6, the needle 1 is shown in the knocked over position. The slider 2 is raised and the stitch 12 comes to bear against the shoulder 6 of the slider. A needle 1' of the opposite section 10 can engage into the slider 2 and pass through the latter via its passage 7 in order to pick up a stitch carried by the slider 2 so as to transfer said stitch. In this position, it can be seen that the beard 3 of the needle 1 is in the U-shaped part of the slider. The play between the needle 1 and the slider 2 makes it possible for the stitch or stitches located in the beard 3 of the needle to engage into the slider, without being damaged.

Figure 7:
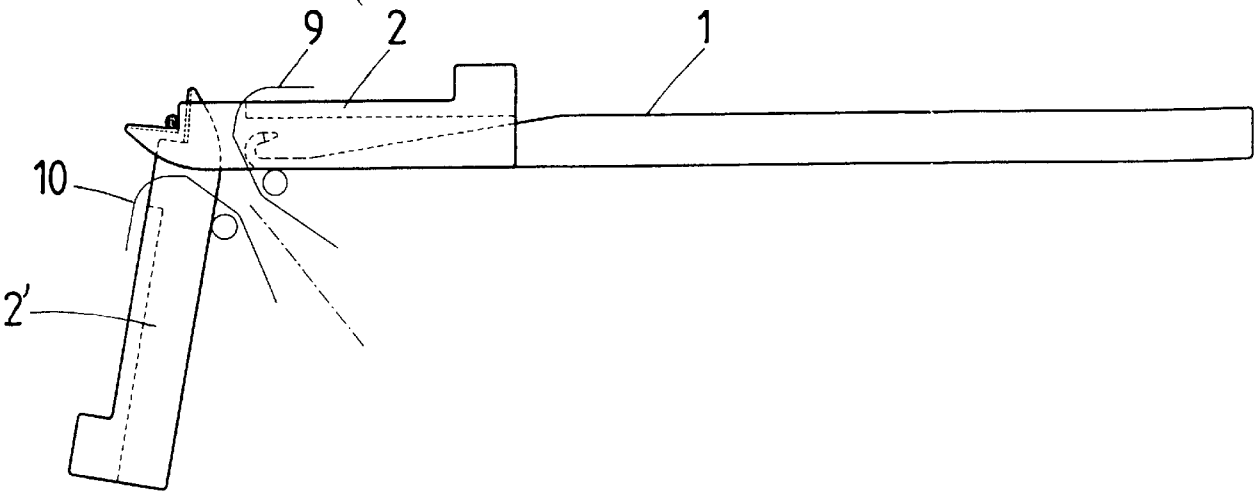
FIG. 7 shows the slider type needle in the position for punching by means of the slider of a needle of the opposite section.

FIG. 7 shows the slider type needle in the same position as FIG. 6, but, instead of an opposite needle 1' engaging into the slider 2, the corresponding slider 2' engages into the slider 2. When the slider 2 is knocked over, the stitch which was located on the nose of the slider 2 is located on the slider 2'. Here, therefore, the function of the slider 2' is that of a punch. The section 10 can be displaced to the left or right for the purpose of transferring the stitches carried by the sliders 2' onto needles 1 of the section 9 or onto sliders 2 of the section 9, with a view to transfer onto the needles of the section 10. All possibilities are thus afforded.

It is expedient to note that the technique of the plugged hole remains possible and that a comb transfer, as described in the patent EP 0 362 126, is also possible with the slider.

We claim:

1. A slider type needle for a knitting machine, comprising a needle (1) equipped with a beard (3) and a slider (2) having an associated length, a butt (4), a nose (5) and a stitch bearing shoulder (6) having a rear, the slider being displaceable relative to the needle in order to close and open the beard of the needle and in order to permit the nose and shoulder of the needle to drive a stitch so as to execute a stitch transfer, wherein the slider has a U-shaped profile which permits the slider to straddle the needle, and wherein the slider is split (7, 15) in an end region thereof comprising the nose, in order to carry out a stitch transfer or punching.

2. The slider type needle as claimed in claim 1, wherein the slider (2) has, over part of its length, starting from the nose, an average inside width which is substantially greater than the thickness of the needle, so as to make it possible for a stitch to pass between the needle and the slider.

3. The needle as claimed in claim 1, wherein the slider (2) has a passage (7) in the end region thereof.

* * * * *